US009679733B2

(12) United States Patent
Dunker

(10) Patent No.: US 9,679,733 B2
(45) Date of Patent: Jun. 13, 2017

(54) ACTUATION SYSTEM FOR AN ELECTRICAL SWITCHING DEVICE

(71) Applicant: Cooper Technologies Company, Houston, TX (US)

(72) Inventor: Jessica Ann Dunker, Wildwood, MO (US)

(73) Assignee: COOPER TECHNOLOGIES COMPANY, Houston, TX (US)

( * ) Notice: Subject to any disclaimer, the term of this patent is extended or adjusted under 35 U.S.C. 154(b) by 170 days.

(21) Appl. No.: 14/505,085

(22) Filed: Oct. 2, 2014

(65) Prior Publication Data

US 2016/0099117 A1 Apr. 7, 2016

(51) Int. Cl.

| | |
|---|---|
| ***H01H 71/52*** | (2006.01) |
| ***H01H 9/22*** | (2006.01) |
| *H01H 3/40* | (2006.01) |
| *H01H 85/54* | (2006.01) |

(52) U.S. Cl.

CPC ..... *H01H 71/52* (2013.01); *H01H 9/223* (2013.01); *H01H 3/40* (2013.01); *H01H 85/54* (2013.01)

(58) Field of Classification Search

CPC H01H 9/22; H01H 71/56; H01H 3/10; H01H 11/0018; H01H 2071/565; H01H 3/08

USPC ..... 200/330, 331, 50.05, 337, 293; 74/29, 74/30, 46, 89.11

See application file for complete search history.

(56) References Cited

U.S. PATENT DOCUMENTS

| | | | | |
|---|---|---|---|---|
| 3,649,785 | A * | 3/1972 | Dietrich | H01H 21/285 200/47 |
| 6,194,983 | B1 * | 2/2001 | Bogdon | G05G 1/04 200/329 |
| 6,974,922 | B2 * | 12/2005 | Bortolloni | H01H 9/223 200/50.05 |
| 7,116,194 | B2 * | 10/2006 | Azzola | H01H 1/2058 200/303 |
| 2005/0224324 | A1 * | 10/2005 | Bortolloni | H01H 9/223 200/50.06 |
| 2009/0107819 | A1 * | 4/2009 | Samudrikam | H01H 3/10 200/336 |
| 2013/0015940 | A1 | 1/2013 | Dunker | |

* cited by examiner

*Primary Examiner* — Edwin A. Leon
*Assistant Examiner* — Ahmed Saeed
(74) *Attorney, Agent, or Firm* — Armstrong Teasdale LLP

(57) ABSTRACT

An actuation system for a switch assembly having at least one switch includes a linear actuator drivable for actuating the switch, and a handle configured for selectively driving the linear actuator. The handle is operable in a first state in which the handle is coupled to the linear actuator such that turning the handle does not drive the linear actuator, and a second state in which the handle is coupled to the linear actuator such that turning the handle drives the linear actuator.

22 Claims, 11 Drawing Sheets

ACTUATION SYSTEM FOR AN ELECTRICAL SWITCHING DEVICE

BACKGROUND OF THE INVENTION

The field of the invention relates generally to electrical switching devices and, more specifically, to an actuation system for an electrical switching device.

One such electrical switching device is an electrical disconnect switch, which permits an electrical circuit to be at least partially de-energized for service or maintenance. For example, a disconnect switch may be utilized in an electrical distribution or industrial setting in which machinery is driven by a power source that is to be removed for adjustment or repair of the machinery.

Electrical disconnect switches are often housed within an enclosure, and are sometimes operably coupled to an actuation mechanism that permits the switches to be manually actuated from outside of the enclosure when the enclosure door is closed. It would be useful, however, to enable such an actuation mechanism to be more effective in manually actuating the switches when the door of the enclosure is open.

BRIEF DESCRIPTION OF THE DRAWINGS

Non-limiting and non-exhaustive embodiments are described with reference to the following Figures, wherein like reference numerals refer to like parts throughout the various views unless otherwise specified.

DETAILED DESCRIPTION OF THE INVENTION

Exemplary embodiments of switching device actuation systems are described below. Method aspects will be in part apparent and in part explicitly discussed in the description.

Figure 1:
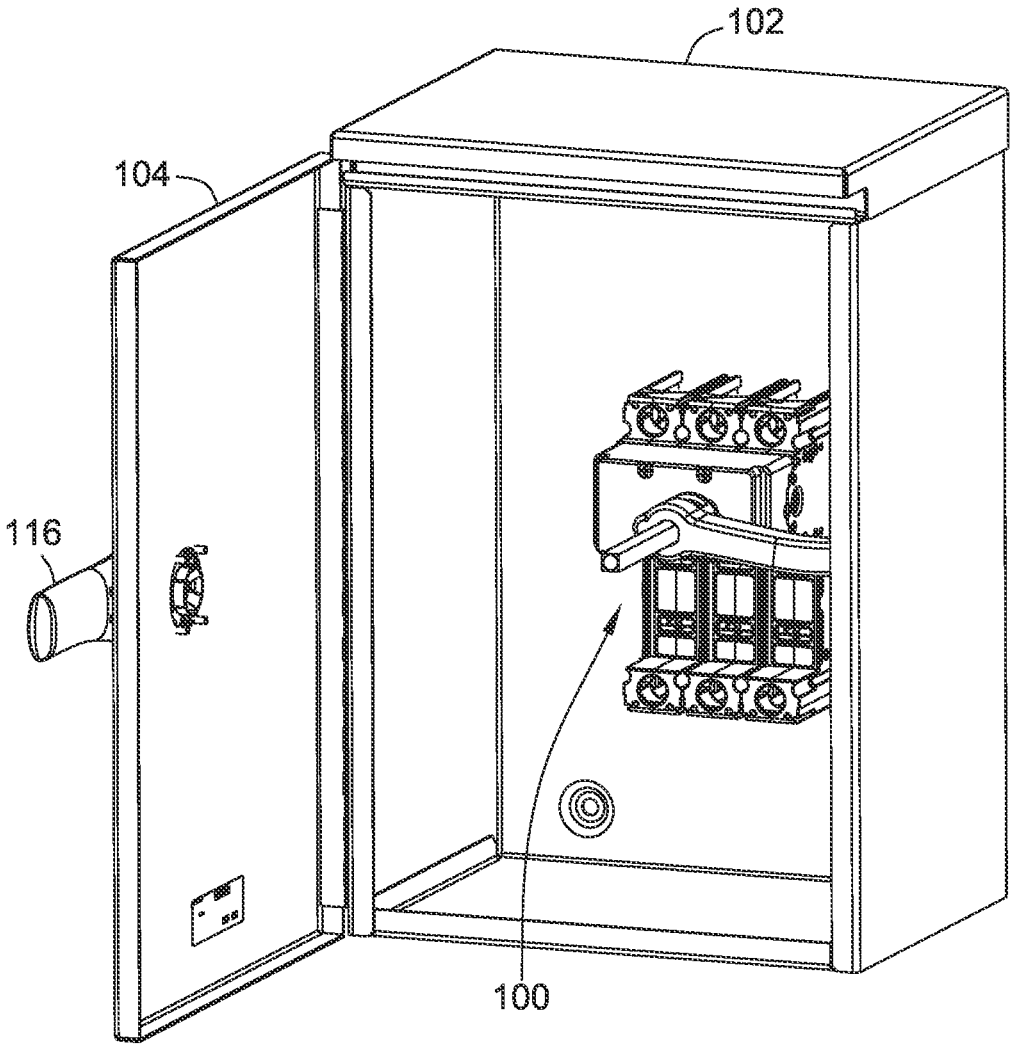
FIG. 1 is a perspective view of a disconnect switch assembly housed within an enclosure.

With reference to FIG. 1, a switch assembly 100 is illustrated as being mounted within an enclosure 102. The enclosure 102 has a door 104 pivotable between a closed position and an open position for accessing the interior of the enclosure 102. The enclosure 102 may be provided with any suitable mechanism for mounting the enclosure 102 on a wall or other support structure (e.g., using a bracket and/or fasteners such as screws).

Figure 2:
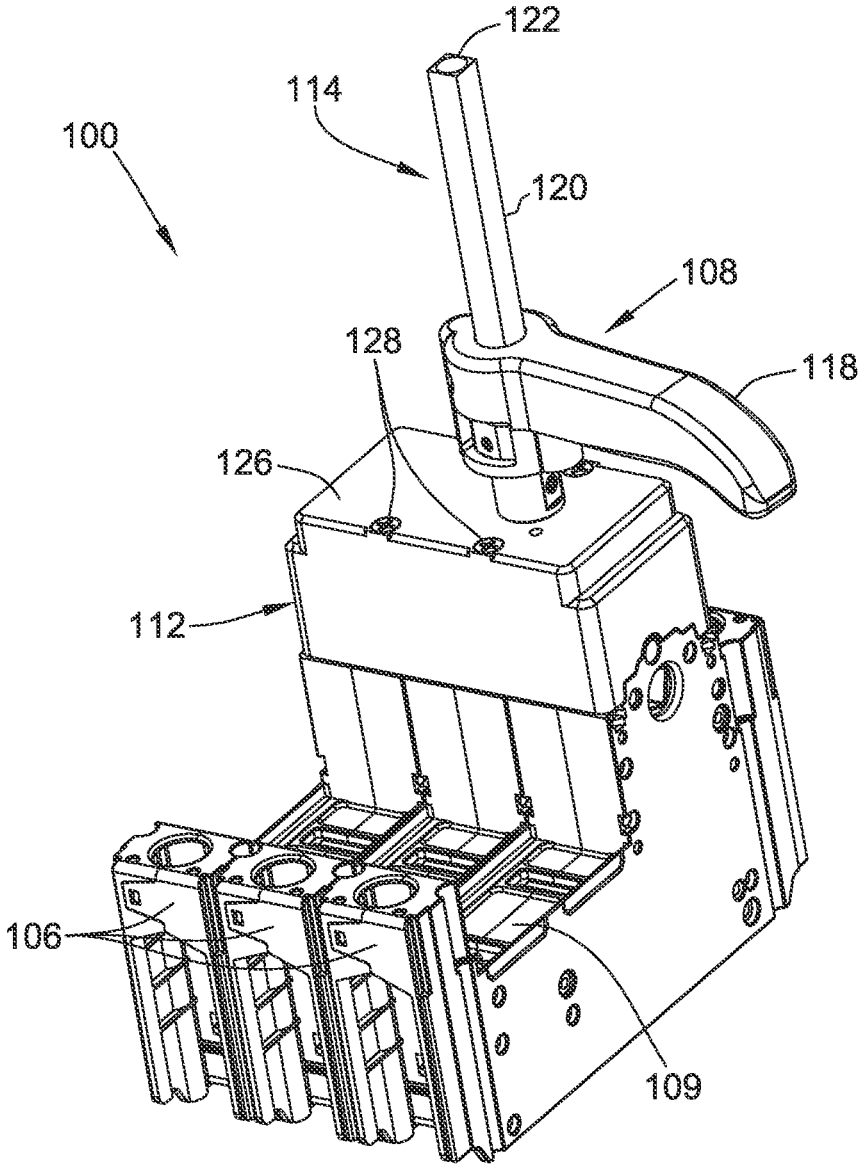
FIG. 2 is a perspective view of the disconnect switch assembly shown in FIG. 1.
Figure 3:
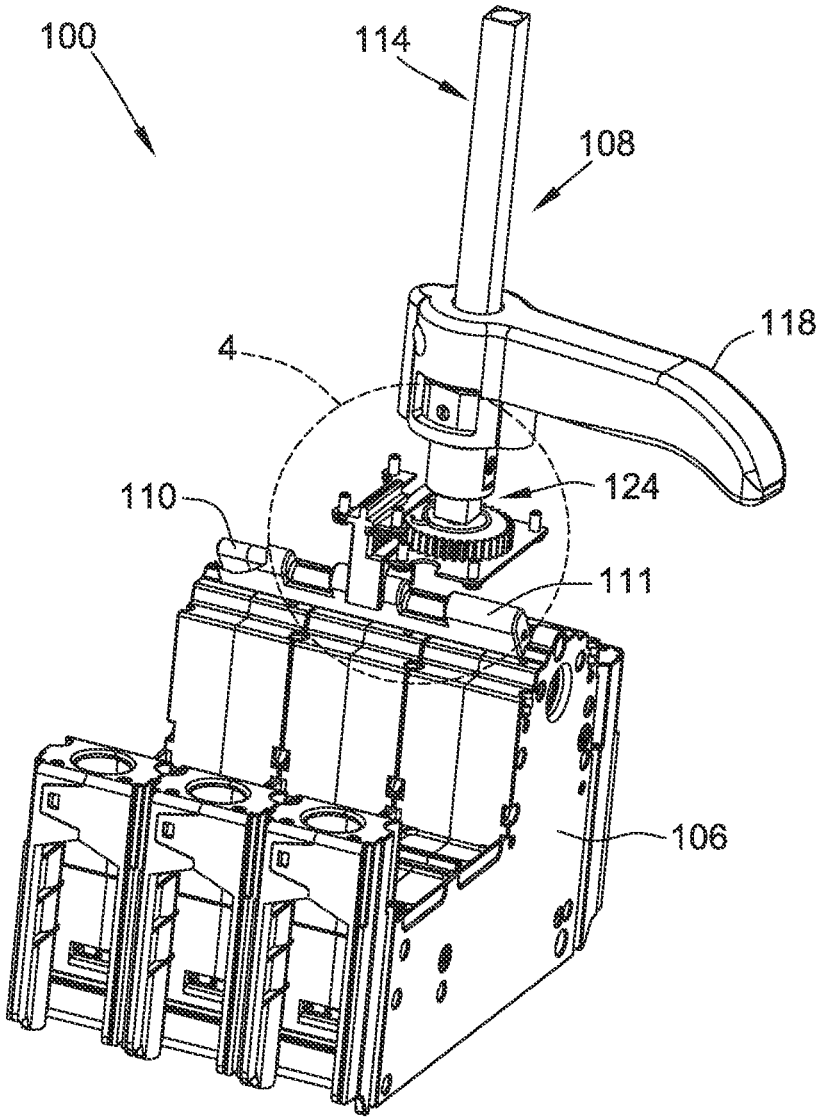
FIG. 3 is a perspective view of the disconnect switch assembly shown in FIG. 1 with a gearbox cover removed to reveal internal components of the gearbox.
Figure 4:
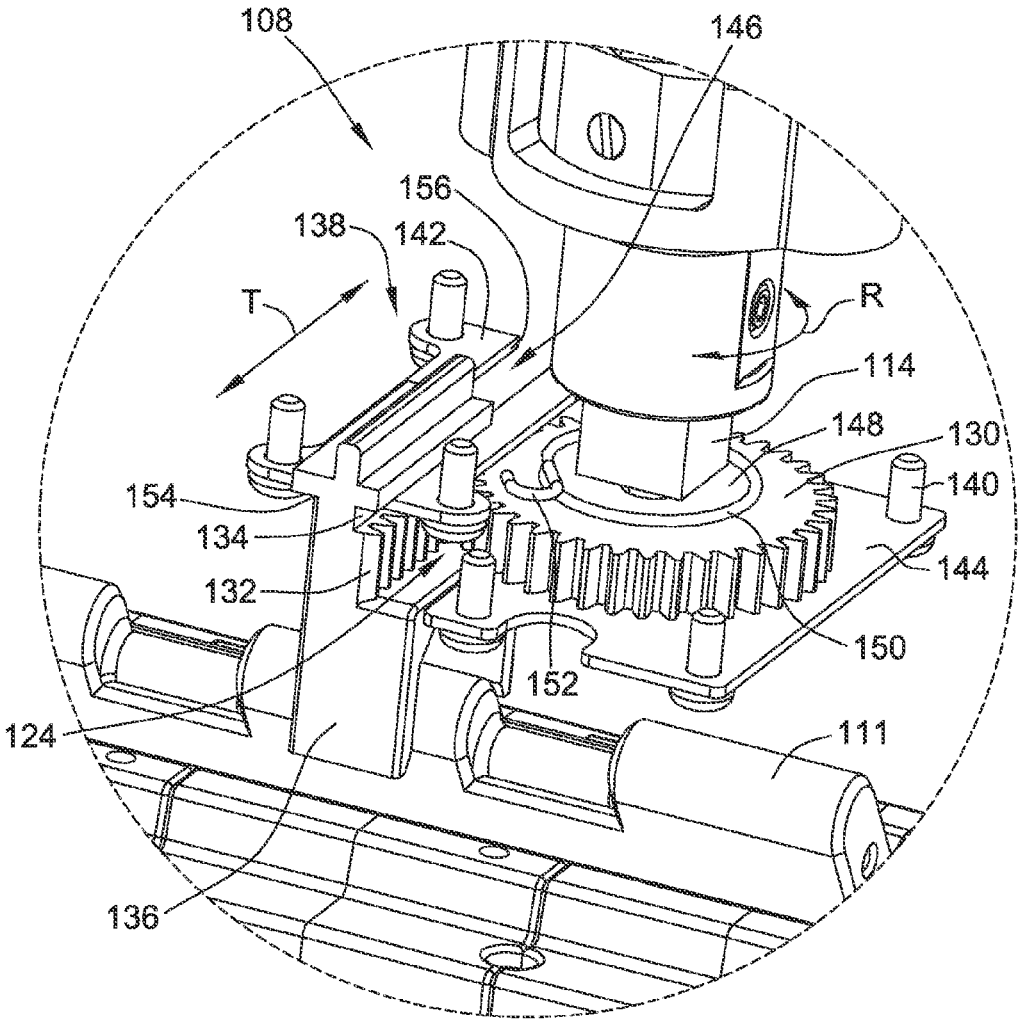
FIG. 4 is an enlarged perspective view of the gearbox components shown in FIG. 3 taken within region 4.

Referring now to FIGS. 2-4, the switch assembly 100 includes a plurality of switches 106 arranged side-by-side, and an actuation system 108 mounted on the switches 106. Notably, in the illustrated embodiment, the plurality of switches 106 includes three fusible disconnect switches (i.e., each illustrated switch 106 is configured as a disconnect switch that defines a seat 109 for receiving a detachable, overcurrent protection fuse module). When seated, each fuse module is readily disengageable from its associated switch 106 by simply grasping and pulling the fuse module away from the switch 106. Such a plug-in connection advantageously facilitates quick and convenient installation and removal of the fuse modules without having to use tools or fuse carrier elements. However, in other embodiments, the switch assembly 100 may include any suitable type and number of switches 106 arranged in any suitable manner that facilitates enabling the actuation system 108 to function as described herein (e.g., the switches 106 may not be disconnect switches, or the switches 106 may not be fusible).

As part of the electrical power system, the switches 106 provide at least one current path between line side circuitry of the power system and load side circuitry of the power system (with the switch assembly 100 and the enclosure 102 said to define a subsystem of the electrical power system). In this manner, each of the switches 106 has an internal switching mechanism that is suitably configured to facilitate electrically disconnecting the load side circuitry from the line side circuitry. For the illustrated switches 106, the internal switching mechanism includes an interface member (e.g., a lever 110, which is shown via cutaway in FIG. 3) that is accessible on the exterior of the switch 106 and is manually displaceable for actuating the switching mechanism. Notably, the various levers 110 are arranged side-by-side and are joined together by an elongate, generally U-shaped sleeve 111 for collective or simultaneous displacement (i.e., displacement together as a single unit) by virtue of displacing the sleeve 111 as set forth in more detail below. Alternatively, the levers 110 may be joined together by any suitable structure(s) that enable the levers 110 to be collectively displaced as described herein; or the levers 110 may not be joined together but, rather, may be configured for displacement independently of one another in any suitable manner that facilitates enabling the actuation system 108 to function as described herein.

The actuation system 108 includes a gearbox 112 (shown assembled in FIG. 2), a shaft 114 operatively coupled to functional components of the gearbox so as to extend from the gearbox 112, and a pair of handles configured for manually rotating the shaft. The pair of handles includes an external handle 116 (FIG. 1) (i.e., a handle that is configured to be grasped by a user on the outside of the enclosure 102 when the door 104 of the enclosure 102 is closed) and an internal handle 118 (i.e., a handle that is configured to be grasped by a user on the inside of the enclosure 102 when the door 104 of the enclosure 102 is open). Notably, the shaft 114 has an intermediate segment 120 and a distal end 122, and the internal handle 118 is irremovably fixed to the intermediate segment 120 of the shaft 114, effectively rendering the internal handle 118 irremovably fixed to the switches 106. As used herein, the term "irremovable" means that the internal handle 118 is not configured for detachment from the shaft 114 (and, therefore, the switches 106) without the use of a tool (e.g., a screwdriver), and furthermore that the internal handle 118 is not intended to be detached from the shaft 114 (and, therefore, the switches 106) in the handle's normal course of operation.

In that regard, the internal handle 118 is disposed within the enclosure 102 and is, therefore, made inaccessible for grasping from the outside of the enclosure 102 when the door 104 is closed. To the contrary, the external handle 116 is not housed within the enclosure 102 but, rather, is mounted on the exterior of the door 104 of the enclosure 102. In this manner, the external handle 116 is configured to slidably receive and operatively engage the distal end 122 of the shaft 114 when the door 104 is closed, meaning that the external handle 116 is operatively disconnected from the distal end 122 of the shaft 114 when the door 104 is open. Alternatively, in other embodiments, the actuation system 108 may not include the external handle 116, but may instead include only the internal handle 118 (i.e., the door 104 may not have an external handle 116 that engages the shaft 114 when the door 104 is closed).

Moreover, the illustrated gearbox 112 includes a linear actuator 124 and a cover 126 surrounding the linear actuator 124. The cover 126 is fastened to the switches 106 using a first set of fasteners 128, and the linear actuator 124 is in the form of a rack-and-pinion gear assembly including a generally circular gear (or pinion 130) engaged with a generally linear gear (or rack 132) that is formed on a peripheral surface 134 of a yoke 136. In some embodiments, the rack 132 may not be formed integrally with the yoke 136 but, rather, may be formed separately from and coupled to the yoke 136 in any suitable manner. Alternatively, in other embodiments, the linear actuator 124 may not be a rack-and-pinion gear assembly but, rather, may be provided in the form of any suitable device that converts rotational motion to translational motion (e.g., a cam-follower assembly).

In the illustrated embodiment, the linear actuator 124 is housed within the cover 126 so as to be suspended on a frame 138 that is fastened to the inside of the cover 126 using a second set of fasteners 140. The frame 138 includes a guide member 142 and a support member 144. The guide member 142 defines a substantially linear channel 146 in which the yoke 136 is disposed in a manner that permits the yoke 136 to be translated along the channel 146 in a direction T. The support member 144 defines a platform on which the pinion 130 is mounted in driving engagement with the rack 132 of the yoke 136 for rotation in a direction R. The shaft 114 is fastened to a central region 148 of the pinion 130, and a coil-type spring 150 is embedded or otherwise fixed to the pinion 130 about the shaft 114. The spring 150 has a hook 152 that is configured to engage the cover 126, providing a bias against clockwise rotation of the pinion 130 in a manner that facilitates providing for smoother and more controlled operation of the linear actuator 124.

In an exemplary operation of the linear actuator 124, the yoke 136 can be disposed in a first position (which is shown in FIG. 4) at a first end 154 of the channel 146, such that a clockwise rotational force imparted on the shaft 114 causes the pinion 130 to rotate clockwise (together with the shaft 114) against the bias of the spring 150. This results in the yoke 136 being translated along the channel 146 from the first position to a second position in which the yoke 136 is disposed at a second end 156 of the channel 146. Likewise, when the yoke 136 is in the second position, a counterclockwise rotational force imparted on the shaft 114 causes the pinion 130 to rotate counterclockwise (together with the shaft 114) in the direction of the spring bias, thereby resulting in the yoke 136 being translated from the second position back to the first position. As such, the yoke 136 can be translated back-and-forth along the channel 146 by simply rotating the shaft 114 in opposite angular directions.

Because the levers 110 of the switches 106 are collectively received in the sleeve 111, and because the sleeve 111 is straddled by the yoke 136 within the cover 126 of the gearbox 112, translation of the yoke 136 from the first position to the second position causes the sleeve 111 to displace the levers 110 from their OFF positions to their ON positions. Alternatively, when the yoke 136 is translated from the second position back to the first position, the yoke 136 causes the sleeve 111 to displace the levers 110 from their ON positions back to their OFF positions. When each lever 110 is in its ON position, the current path through its associated switch 106 from the line side circuitry to the load side circuitry is closed, thereby enabling current to pass from the line side circuitry to the load side circuitry through the switch 106 (i.e., the load side circuitry is said to be energized). On the other hand, when each lever 110 is in its OFF position, the current path through its associated switch 106 from the line side circuitry to the load side circuitry is open, thereby preventing current from passing from the line side circuitry to the load side circuitry through the switch 106 (i.e., the load side circuitry is said to be de-energized or isolated).

In this manner, the shaft 114 can be rotated to toggle the levers 110 between their ON and OFF positions as a collective unit. This enables a user to selectively de-energize the load side circuitry for repairing or replacing components of the power system or associated machinery. Moreover, as set forth in more detail below, the handles 116, 118 are provided to assist the user in rotating the shaft 114 and displacing the levers 110 on demand. Particularly, the external handle 116 is provided for enabling a user to rotate the shaft 114 and actuate the switches 106 when the door 104 of the enclosure 102 is closed, and the internal handle 118 is provided for enabling the user to rotate the shaft 114 and actuate the switches 106 when the door 104 of the enclosure 102 is open.

With specific reference to the external handle 116 (FIG. 1), the external handle 116 is disposed on the outside of the door 104 and may be configured with a suitable latching mechanism that has a latched position (which prevents the door 104 from being pulled open) and an unlatched position (which permits the door 104 to be pulled opened). To obtain the unlatched position of the external handle 116, the external handle 116 can be turned counterclockwise from the latched position. On the other hand, to obtain the latched position of the external handle 116, the external handle 116 can be turned clockwise from the unlatched position. Notably, however, no matter whether the door 104 is latched or unlatched, the distal end 122 of the shaft 114 is slidably received in the external handle 116 whenever the door 104 is closed, so as to render the shaft 114 rotatable via the external handle 116 when the external handle 116 is turned clockwise or counterclockwise.

As such, whenever the external handle 116 is turned counterclockwise from its latched position when the door 104 is closed, the shaft 114 is caused to rotate counterclockwise to move the levers 110 to their OFF positions via the linear actuator 124, opening the current paths through the switches 106 and electrically isolating the load side circuitry from the line side circuitry in the electrical power system. The door 104 can subsequently be opened by virtue of the external handle 116 being in its unlatched position. Likewise, whenever the external handle 116 is turned clockwise from its unlatched position when the door 104 is closed, the shaft 114 is caused to rotate clockwise to move the levers 110 to their ON positions via the linear actuator 124, closing the current paths through the switches 106 and enabling current to flow from the line side circuitry to the load side circuitry in the electrical power system. The door 104 is then prevented from being pulled open by virtue of the external handle 116 being in its latched position.

In this manner, the external handle 116 permits the current paths through the various switches 106 to be simultaneously closed or opened without the user having to actually pull the door 104 of the enclosure 102 open. Rather, by simply rotating the external handle 116 counterclockwise when the door 104 is closed (as if to unlatch the door 104), the load side circuitry is electrically disconnected from the line side circuitry, while the line side circuitry remains "live" in an energized, full power condition. Then, after electrically disconnecting the load side circuitry from the line side circuitry, the load side circuitry and/or its associated load (e.g., the industrial equipment that it serves to power) can be serviced or replaced; or, alternatively, the door 104 of the enclosure 102 can be opened such that components of the switch assembly 100 itself can be serviced or replaced.

Figure 5:
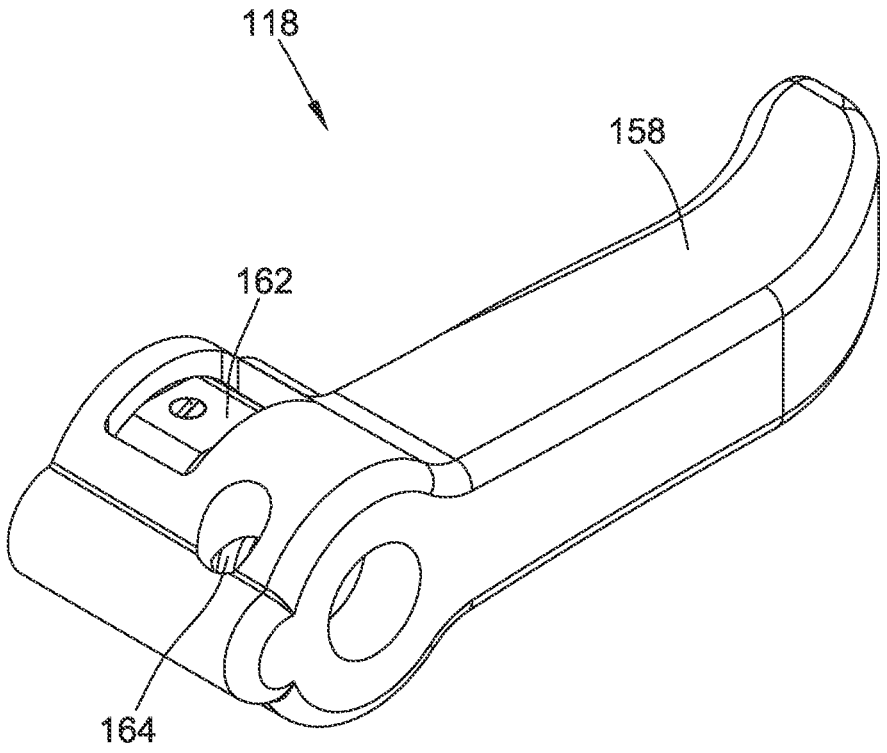
FIG. 5 is a perspective view of a handle of the disconnect switch assembly shown in FIG. 1.
Figure 6:
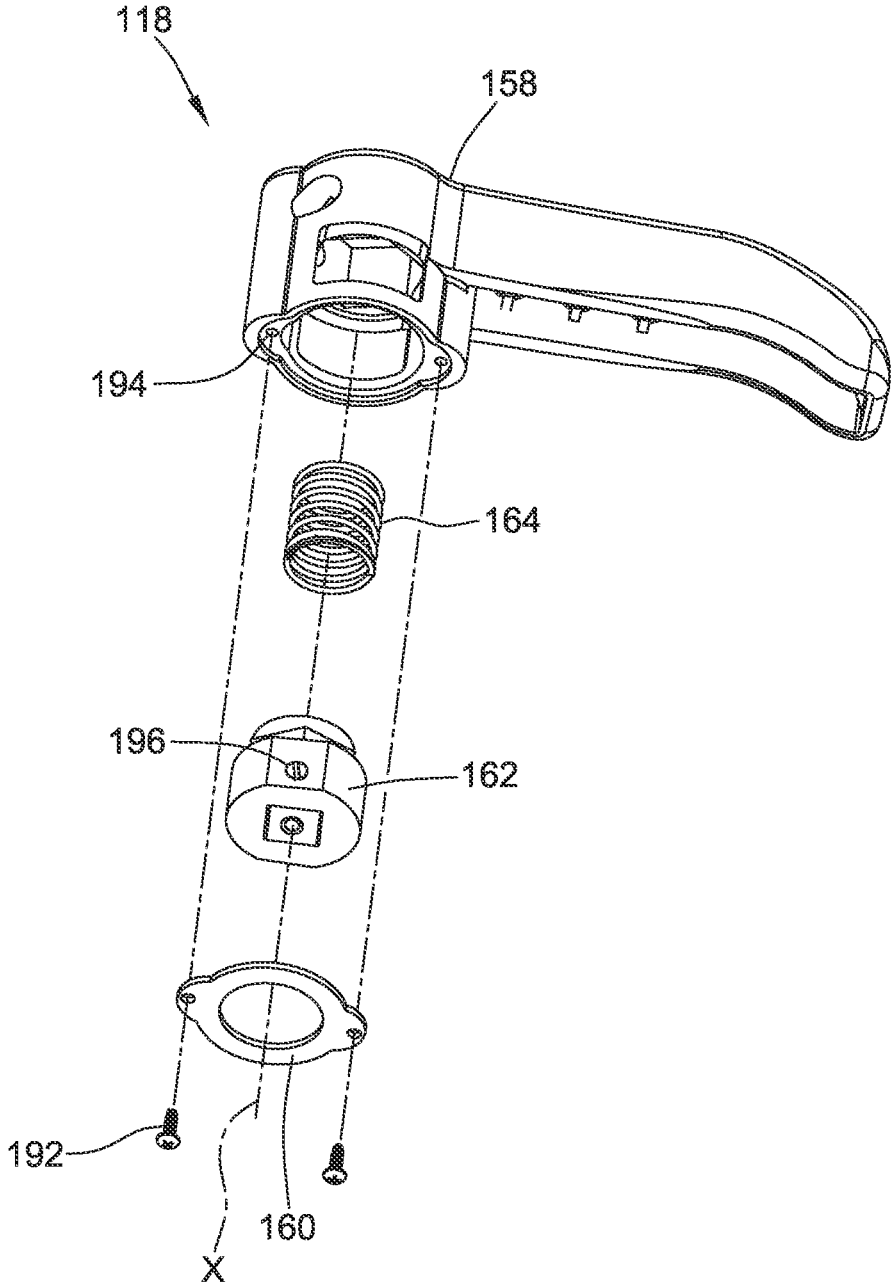
FIG. 6 is an exploded view of the handle shown in FIG. 5.
Figure 7:
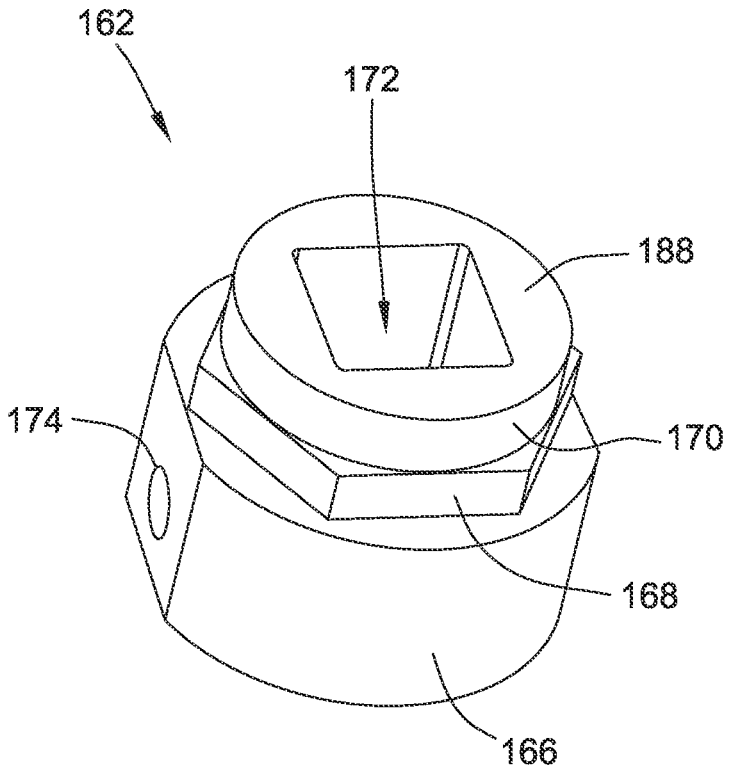
FIG. 7 is a perspective view of a lug of the handle shown in FIG. 5.

Under some circumstances, however, the user may seek to re-energize the load side circuitry when the door 104 of the enclosure 102 is open, and the internal handle 118 is configured to facilitate such a task. With specific reference now to FIGS. 5 and 6, the internal handle 118 includes a housing 158, a cap 160, a lug 162, and a spring 164. As shown in FIG. 7, the lug 162 is a unitarily formed structure (e.g., a cast metal structure) having a body 166, a key 168 projecting from the body 166, and a boss 170 projecting from the key 168. The lug 162 further includes a passage 172 extending through the lug 162 from the body 166 to the boss 170, as well as a pair of threaded holes 174 disposed on opposing sides of the body 166 so as to be in communication with the passage 172. Notably, the boss 170 is narrower than the key 168 (i.e., the boss 170 has a smaller transverse dimension than the key 168, as measured perpendicular to a lengthwise center axis X (FIG. 6) of the passage 172).

In the illustrated embodiment, the passage 172 has a substantially polygonal (e.g., substantially square) cross-sectional shape (as taken perpendicular to the lengthwise center axis X of the passage 172). Thus, the lug 162 is sized for receiving the shaft 114 through the passage 172, given that the shaft 114 also has a substantially polygonal (e.g., substantially square) cross-sectional shape substantially matching that of the passage 172. Moreover, the illustrated boss 170 has a substantially round cross-sectional shape (as taken perpendicular to the lengthwise center axis X of the passage 172), and the key 168 has a substantially polygonal (e.g., substantially hexagonal) cross-sectional shape (as taken perpendicular to the lengthwise center axis X of the passage 172). Alternatively, in other embodiments, the passage 172, the key 168, and the boss 170 may have any suitable geometric configurations that facilitate enabling the lug 162 to function as described herein (e.g., the passage 172 and the shaft 114 may have substantially matching substantially triangular cross-sectional shapes, or the key 168 may have a substantially octagonal cross-sectional shape).

Figure 8:
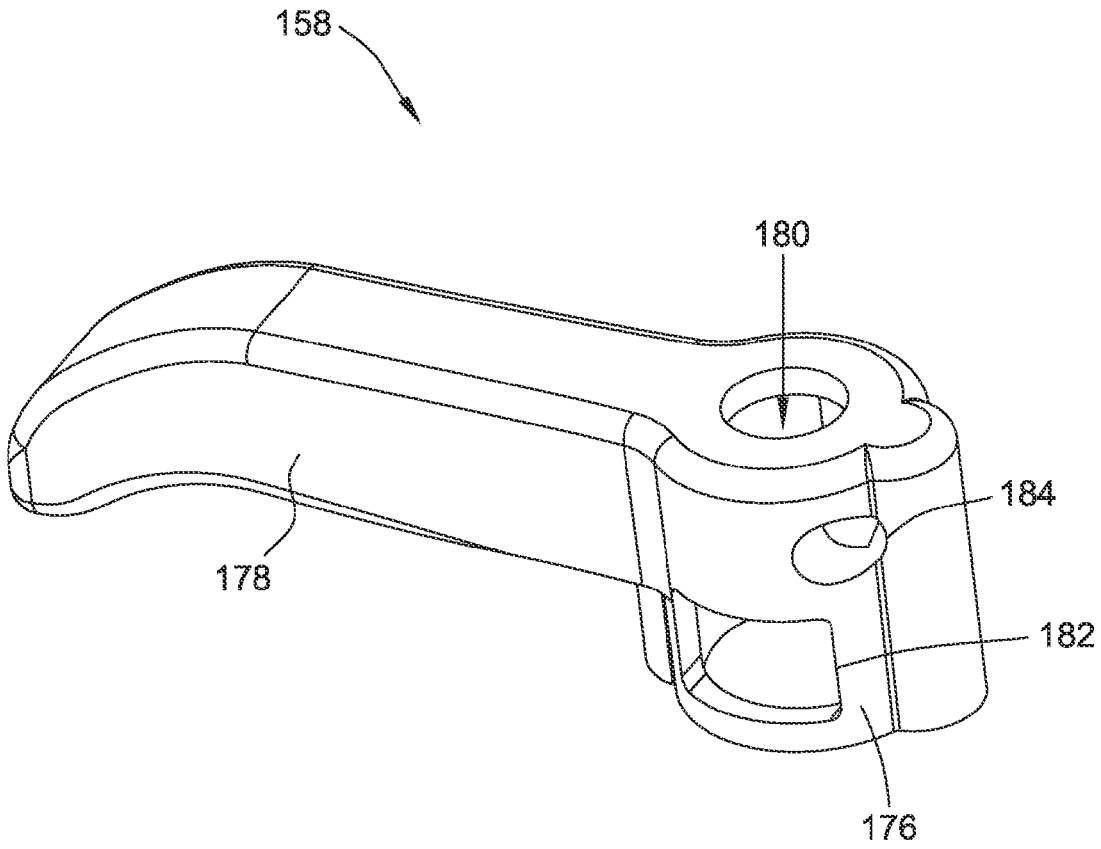
FIG. 8 is a top perspective view of a housing of the handle shown in FIG. 5.
Figure 9:
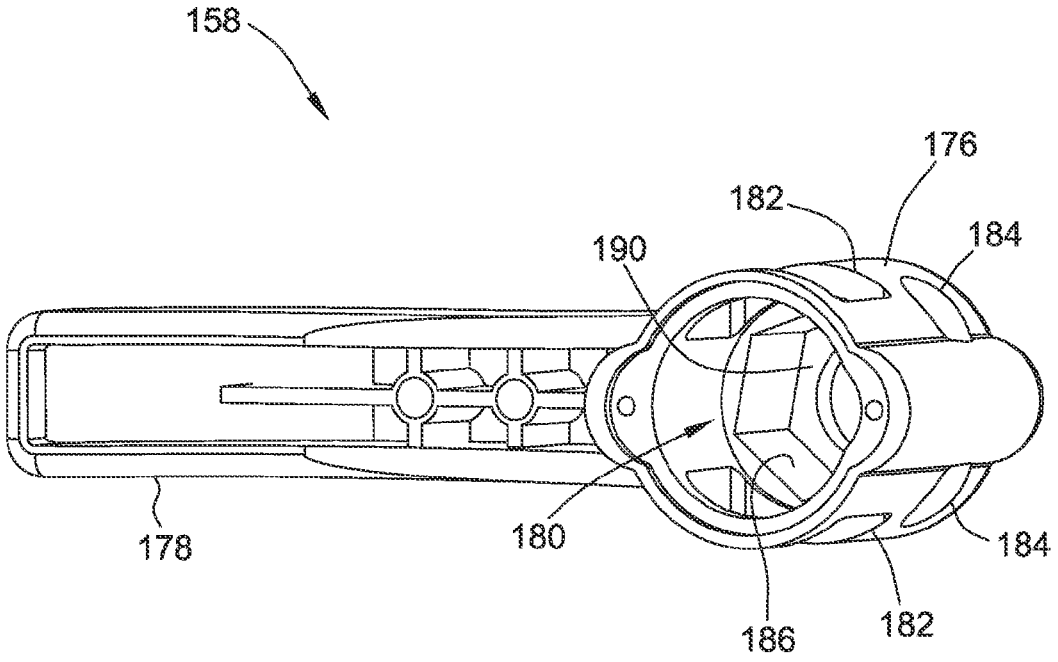
FIG. 9 is a bottom perspective view of the housing shown in FIG. 8.

As shown in FIGS. 8 and 9, the housing 158 has a base 176 and a grip 178 extending from the base 176. The base 176 has hollow core 180 that extends through the base 176 substantially perpendicular to the outward extension of the grip 178. The base 176 further defines a pair of windows 182 that are aligned with one another on opposite sides of the core 180, as well as a pair of openings 184 that are aligned with one another on opposite sides of the core 180, such that the windows 182 and the openings 184 are in communication with the core 180.

With particular reference to FIG. 9, the base 176 also defines a keyhole 186 in the core 180. As set forth in more detail below, the keyhole 186 is sized to freely receive the boss 170 of the lug 162 without the base 176 engaging the boss 170 (i.e., when the boss 170 is inserted into the keyhole 186, the keyhole 186 can freely rotate about the boss 170 without the base 176 rotatably engaging the boss 170). Moreover, the keyhole 186 is further sized to receive the key 168 of the lug 162 so as to engage the key 168 (i.e., when the key 168 is inserted into the keyhole 186, the keyhole 186 is not freely rotatable about the key 168 without the base 176 rotatably engaging the key 168).

Figure 10:
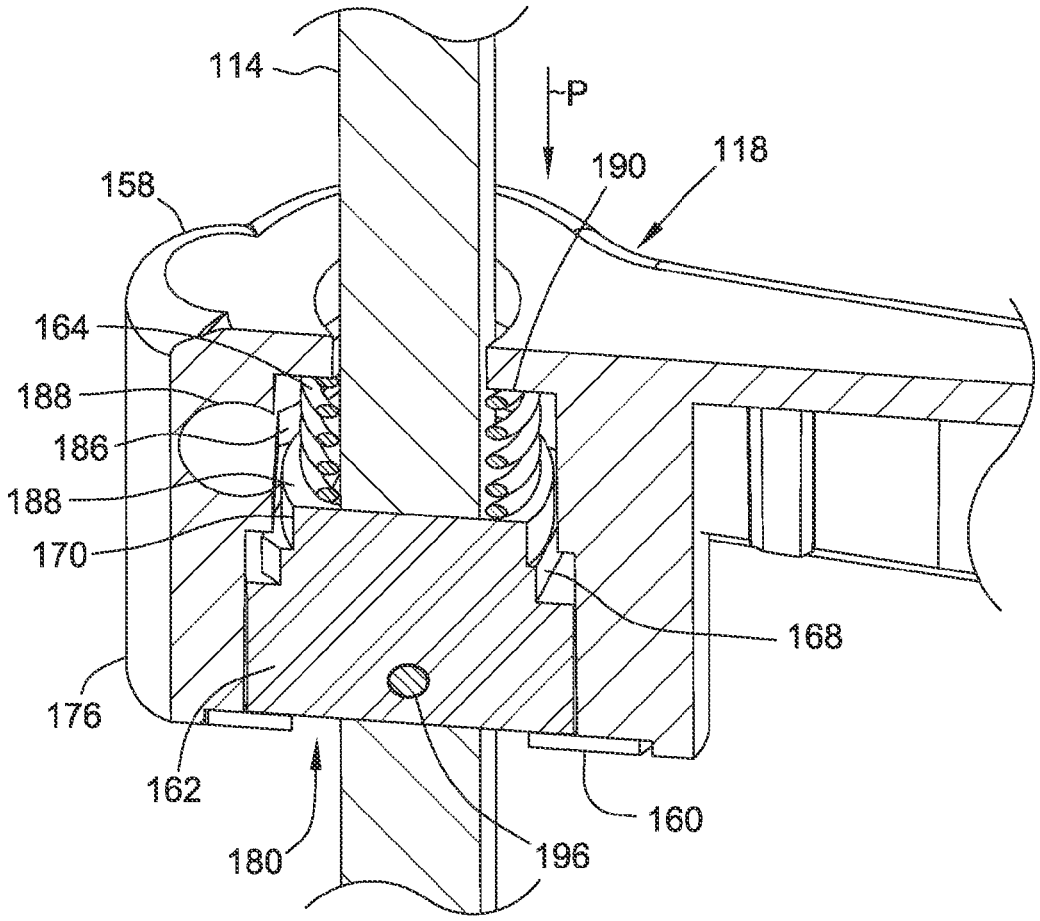
FIG. 10 is a cross-sectional view of the handle shown in FIG. 5 in a first state and mounted on a shaft of the disconnect switch assembly shown in FIG. 1.

Referring now to FIG. 10, in its assembled configuration, the lug 162 and the spring 164 are inserted into the core 180 of the housing 158 such that the spring 164, at its one end, abuts a top face 188 of the boss 170 and, at its other end, abuts a spring seat 190 of the base 176. With the lug 162 and the spring 164 disposed in the core 180, the cap 160 is then fastened to the base 176 of the housing 158 via a third set of fasteners 192 (shown in FIG. 6) inserted into holes 194 (shown in FIG. 6) of the base 176, thereby retaining the lug 162 and the spring 164 within the core 180 such that the spring 164 is sandwiched between the boss 170 of the lug 162 and the spring seat 190 of the base 176. In this manner, the spring 164 is in a first degree of compression, biasing the lug 162 against the cap 160 to stabilize and maintain the lug 162 properly aligned inside the core 180.

To couple the assembled internal handle 118 to the shaft 114, the shaft 114 is inserted through the cap 160, through the passage 172 of the lug 162, and through the spring 164, so as to extend through the entire base 176 via the core 180. To retain the internal handle 118 fixed on the shaft 114, a set screw 196 (also shown in FIG. 6) is inserted into each of the threaded holes 174 of the lug 162 via the windows 182 of the housing 158, and the set screws 196 are then tightened against the shaft 114 to inhibit the lug 162 from sliding along the shaft 114. Notably, because the lug 162 rotatably engages (or mates with) the shaft 114 by virtue of the passage 172 and the shaft 114 having substantially the same substantially polygonal cross-sectional shape, the lug 162 is not rotatable relative to the shaft 114.

By virtue of the spring 164 biasing the housing 158 away from the lug 162 toward the distal end 122 of the shaft 114 (herein referred to as the "up" direction on the shaft 114), the housing 158 is displaceable (or floatable) toward the lug 162 and away from the distal end 122 along the shaft 114 (herein referred to as the "down" direction on the shaft 114) against the bias of the spring 164. Notably, when the housing 158 of the internal handle 118 is fully biased up the shaft 114 by the spring 164 (i.e., when the cap 160 is abutting the lug 162), the internal handle 118 is said to be in a first state, in which the housing 158 does not rotatably engage the lug 162 (i.e., the key 168 of the lug 162 is not inserted into the keyhole 186 of the housing 158 and, therefore, the housing 158 is not rotatably engaged with the lug 162). Importantly, in the first state, the shaft 114 cannot be rotated by turning the housing 158 of the internal handle 118.

As mentioned above, when the internal handle 118 is in the first state, the housing 158 and the cap 160 are conjointly displaceable (or floatable) down the shaft 114 against the bias of the spring 164 if pushed in the direction P. In this manner, the internal handle 118 can be converted from the first state to a second state by pushing the housing 158 in the direction P such that the keyhole 186 of the housing 158 is brought into rotatable engagement with the key 168 of the lug 162. Because the lug 162 is not movable along the shaft 114, such a displacement of the housing 158 effectively further compresses the spring 164 into a second degree of compression that is of greater magnitude than the first degree of compression.

Figure 10A:
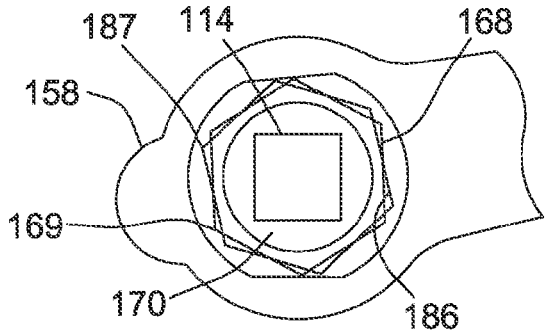
FIG. 10A is a schematic elevation detail view of a keying feature of the handle shown in FIG. 5 in the first state and mounted on the shaft as shown FIG. 10.

However, as shown in FIG. 10A, the housing 158 is configured to have an angular orientation in the first state that prevents keying of the housing 158 to the lug 162 in the event of an inadvertent displacement of the housing 158 downward on the shaft 114. More specifically, in the first state, the housing 158 is oriented such that the vertices 187 of the substantially polygonal shape of the keyhole 186 are angularly offset relative to the vertices 169 of the substantially polygonal shape of the key 168. In this manner, merely pushing the housing 158 down the shaft 114 in the direction P will not in and of itself insert the key 168 into the keyhole 186. Rather, to effectively insert the key 168 into the keyhole 186, the housing 158 is to be rotated slightly in order to align the vertices 169 of the key l68 with the vertices 187 of the keyhole 186. Such a feature facilitates ensuring that any keying of the housing 158 to the lug 162 is intentional and not inadvertent.

Figure 11:
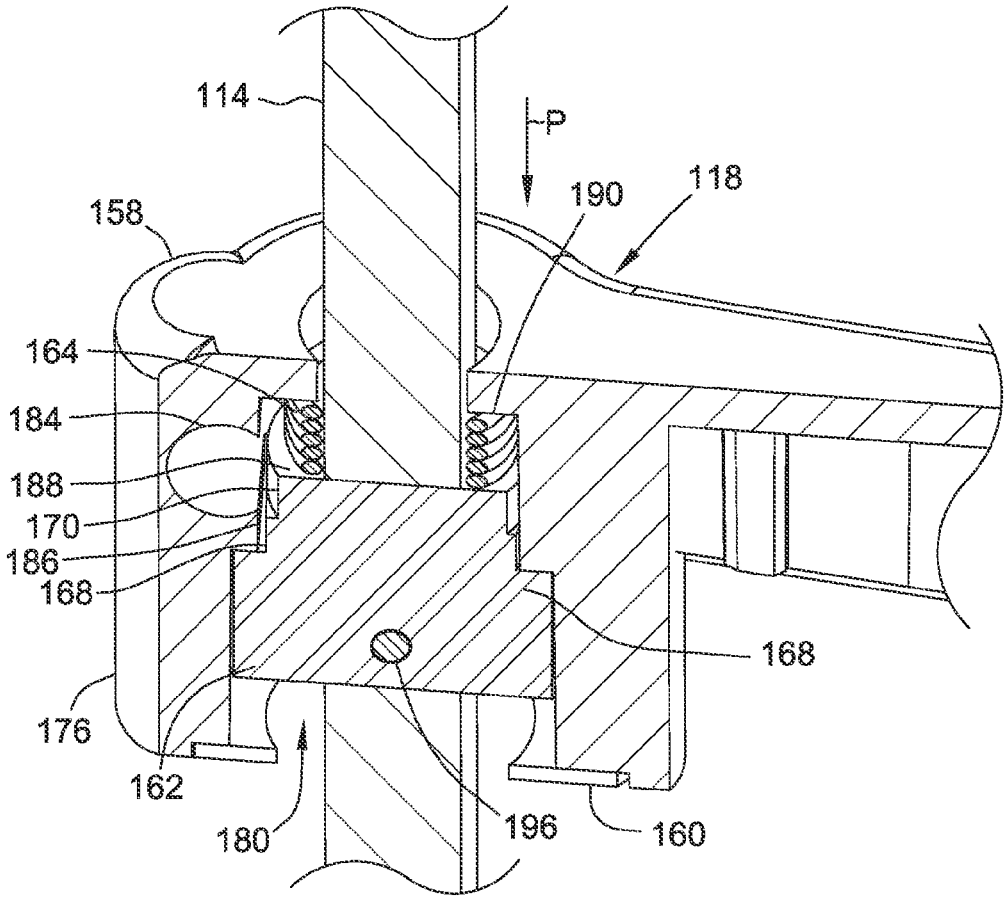
FIG. 11 is a cross-sectional view of the handle mounted on the shaft as shown in FIG. 10, but in a second state of the handle rather than the first state shown in FIG. 10.
Figure 11A:
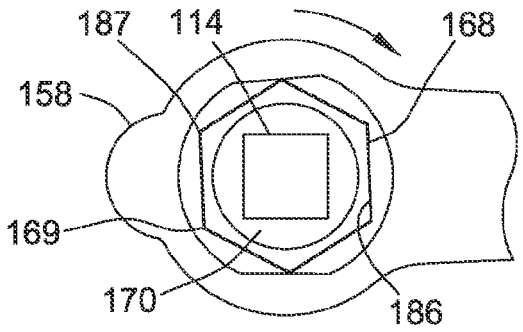
FIG. 11A is a schematic elevation detail view of the keying feature shown in FIG. 10A, but in the second state of the handle as shown in FIG. 11.

FIG. 11 illustrates the internal handle 118 after it has been converted from the first state to the second state. More specifically, because the user has pushed the housing 158 down the shaft 114 in the direction P and has slightly rotated the housing 158 relative to the lug 162 to align the vertices 169, 187 of the key 168 and the keyhole 186 (as shown in FIG. 11A), the key 168 of the lug 162 has been inserted into the keyhole 186 of the housing 158. The lug 162 (and the shaft 114) are thereby rotatable together with the housing 158 since the substantially polygonal shapes of the key 168 and the keyhole 186 are mated together. In this position (i.e., the second state of the internal handle 118), the internal handle 118 is said to be keyed on the shaft 114. Briefly referring back to FIG. 4, when the internal handle 118 is in its second state and the shaft 114 is rotated via the internal handle 118 as described above, the yoke 136 can be translated between its first position (at the first end 154 of the channel 146) and its second position (at the second end 156 of the channel 146) by virtue of the linear actuator 124, causing the sleeve 111 to displace the levers 110 between their ON and OFF positions as desired.

Notably, when the internal handle 118 is no longer held in its second state by the user, the spring 164 is permitted to decompress from the second degree of compression back to the first degree of compression, thereby pushing the housing 158 up the shaft 114 to automatically convert the internal handle 118 from the second state back to the first state. Moreover, in the event that locking the internal handle 118 from unauthorized use is desired, a locking device (e.g., a padlock) can be coupled to the internal handle 118 with the shackle of the locking device inserted through the openings 184 of the housing 158 to effectively prevent the housing 158 from being pushed down the shaft 114 enough of a distance to rotatably engage the key 168 with the keyhole 186, thereby rendering the internal handle 118 completely inoperable when locked.

As is evident from the above description, the illustrated internal handle 118 provides a convenient way to energize or de-energize the load side circuitry of the electrical power system when the door 104 of the enclosure 102 is open. Particularly, the internal handle 118 is operable in one of two states, namely a first state (in which the grip 178 can be turned, but such turning of the grip 178 does not result in rotation of the shaft 114) and a second state (in which the grip 178 can be turned, and such turning does result in rotation of the shaft 114). Transitioning the internal handle 118 between the first state and the second state can be accomplished by slightly turning and pushing the grip 118 downward along the shaft 114 in the direction P.

In one exemplary method of actuating the switch assembly 100 using the actuation system 108, when the door 104 of the enclosure 102 is closed and the a user turns the external handle 116 counterclockwise, the shaft 114 also turns counterclockwise and effectively de-energizes the load side circuitry of the electrical power system by virtue of the linear actuator 124. With the load side circuitry de-energized, the user opens the door 104 of the enclosure 102 to inspect the switch assembly 100. However, with the door 104 of the enclosure 102 open (i.e., with the external handle 116 not engaged with the shaft 114), the user desires to re-energize the load side circuitry to test its functionality. To accomplish such a task without closing the door 104, the user simply grasps the grip 178 of the internal handle 118 and slightly rotates and pushes the housing 158 down the shaft 114 in the direction P until the keyhole 186 of the housing 158 engages the key 168 of the lug 162, at which point subsequent clockwise rotation of the grip 178 causes the shaft 114 to rotate clockwise which causes the switch assembly 100 to re-energize the load side circuitry.

After the user has re-energized the load side circuitry with the door 104 open, the user releases the grip 178 to inspect the switch assembly 100, and the spring 164 somewhat decompresses and biases the housing 158 back up the shaft 114 to rotatably disengage the housing 158 from the lug 162, which again renders the housing 158 freely turnable relative to the shaft 114 without causing rotation of the shaft 114. After completing the inspection of the switch assembly 100 while the load side circuitry is energized, the user de-energizes the load side circuitry again using the internal handle 118. With the load side circuitry de-energized, the user shuts the door 104 of the enclosure 102 before turning the external handle 116 clockwise to re-energize the load side circuitry. In this manner, the internal handle 118 provides a convenient way to energize and de-energize the load side circuitry of an electrical power system when the door 104 of the enclosure 102 is open.

An embodiment of an actuation system for a switch assembly having at least one switch has been disclosed. The actuation system includes: a linear actuator drivable for actuating the switch; and a handle configured for selectively driving the linear actuator, wherein the handle is operable in a first state in which the handle is coupled to the linear actuator such that turning the handle does not drive the linear actuator, and a second state in which the handle is coupled to the linear actuator such that turning the handle drives the linear actuator.

Optionally, the linear actuator includes a rack-and-pinion gear assembly. The actuation system may also include a shaft coupled between the linear actuator and the handle, wherein the handle is configured to turn relative to the shaft in the first state and is configured for rotating the shaft when turned in the second state. The handle may be configured for keyed interaction with the shaft. The handle may include a spring and a housing displaceable along the shaft against a bias of the spring to enable the keyed interaction of the handle with the shaft. The actuation system may also include a lug coupled to the shaft, wherein the lug defines a key and the housing defines a keyhole such that the key of the lug is insertable into the keyhole of the housing to enable the keyed interaction of the handle with the shaft. The housing may be configured to receive a locking device in a manner that inhibits the housing from being displaced along the shaft to prevent the keyed interaction.

An embodiment of a switch assembly comprising: at least one switch; and an actuation system for actuating the switch, wherein the actuation system comprises: a gearbox mounted on the switch, wherein the gearbox comprises a linear actuator configured for actuating the switch; a shaft coupled to the linear actuator and projecting from the gearbox such that rotation of the shaft drives the linear actuator; and a handle irremovably fixed to the shaft for rotating the shaft to drive the linear actuator.

Optionally, the at least one switch may include a plurality of switches each comprising a lever, with the actuation system being configured to collectively displace the levers of the switches. The actuation system may also include an elongate sleeve that receives the levers, and the linear actuator may be configured to collectively displace the levers by displacing the sleeve. The gearbox may include a cover sized to surround the linear actuator and the sleeve. The linear actuator may include a rack-and-pinion gear assembly. The actuation system may further include a yoke configured to straddle the sleeve for displacing the sleeve. The rack-and-pinion gear assembly may include a rack integrally formed with the yoke.

An embodiment of a subsystem for electrically isolating load side circuitry from line side circuitry in an electrical power system has also been disclosed. The subsystem includes: an enclosure comprising a door; and a switch assembly housed within the enclosure, wherein the switch assembly comprises at least one switch and an actuation system for actuating the switch, the actuation system having a handle for manually operating the actuation system such that the handle is configured for disposition within the enclosure when the door is closed.

Optionally, the actuation system may include a gearbox and a shaft, the shaft having an intermediate segment and a distal end such that the shaft projects from the gearbox to the distal end with the handle fixed to the intermediate segment of the shaft. The handle may be irremovably fixed to the shaft.

18. The subsystem of claim 16, wherein the gearbox is mounted on the switch. The handle may be an internal handle, and wherein the actuation system also has an external handle mounted on the door such that the external handle engages the distal end of the shaft when the door is closed and disengages the distal end of the shaft when the door is opened. The switch may be a fusible disconnect switch. The fusible disconnect switch may include a seat configured for receiving a detachable, overcurrent protection fuse module in a plug-in connection of the fuse module to the seat. The at least one switch may include a plurality of the fusible disconnect switches arranged side-by-side.

An embodiment of a subsystem for electrically isolating load side circuitry from line side circuitry in an electrical power system has also been disclosed, the subsystem includes: a fusible disconnect switch; and an actuation system for actuating the fusible disconnect switch, wherein the actuation system includes a handle for manually operating the actuation system, the handle being irremovably fixed to the fusible disconnect switch.

Optionally, the subsystem may include an enclosure having a door, the fusible disconnect switch and the handle being housed within the enclosure. The handle may be an internal handle, and the actuation system may include an external handle mounted on the door of the enclosure, with the external handle being configured for manually operating the actuation system when the door is closed. The actuation system may include a shaft configured for driving the actuation system when rotated, the internal handle being irremovably fixed to the shaft, the external handle being removably fixable to the shaft when the door is closed.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. An actuation system for a switch assembly having at least one switch, the actuation system comprising:

a linear actuator drivable for actuating the at least one switch;

a handle for selectively driving the linear actuator, wherein the handle is operable in a first state in which the handle is coupled to the linear actuator such that turning the handle does not drive the linear actuator, and a second state in which the handle is coupled to the linear actuator such that turning the handle drives the linear actuator;

a shaft coupled between the linear actuator and the handle, wherein the handle turns relative to the shaft in the first state and rotates the shaft when turned in the second state;

wherein the handle is coupled to the shaft for keyed interaction with the shaft;

wherein the handle comprises a spring and a housing displaceable along the shaft against a bias of the spring to enable the keyed interaction of the handle with the shaft; and a lug coupled to the shaft, wherein the lug defines a key and the housing defines a keyhole such that the key of the lug is insertable into the keyhole of the housing to enable the keyed interaction of the handle with the shaft;

wherein the housing receives a locking device in a manner that inhibits the housing from being displaced along the shaft to prevent the keyed interaction.

2. The actuation system of claim 1, wherein the linear actuator comprises a rack-and-pinion gear assembly.

3. The actuation system of claim 1, wherein the at least one switch comprises a plurality of switches each comprising a lever, the actuation system coupled to the plurality of switches for collectively displacing the lever of each of the plurality of switches.

4. The actuation system of claim 3, wherein the actuation system further comprises an elongate sleeve that receives the lever of each of the plurality of switches, the linear actuator collectively displacing the lever of each of the plurality of switches by displacing the sleeve.

5. The actuation system of claim 1, in combination with an enclosure comprising a door, and wherein the handle is disposed within the enclosure when the door is closed.

6. The of actuation system of claim 5, further comprising a gearbox, wherein the shaft has an intermediate segment and a distal end, and wherein the shaft projects from the gearbox to the distal end with the handle fixed to the intermediate segment of the shaft.

7. The actuation system of claim 6, in combination with the at least one switch, wherein the gearbox is mounted on the at least one switch.

8. The actuation system of claim 6, wherein the handle is an internal handle, and wherein the actuation system also has an external handle mounted on the door such that the external handle engages the distal end of the shaft when the door is closed and disengages the distal end of the shaft when the door is opened.

9. The actuation system of claim 1, wherein the at least one switch is a fusible disconnect switch.

10. The actuation system of claim 9, wherein the fusible disconnect switch has a seat that receives a detachable, overcurrent protection fuse module in a plug-in connection of the fuse module to the seat.

11. The actuation system of claim 9, wherein the at least one switch comprises a plurality of the fusible disconnect switches arranged side-by-side.

12. The actuation system of claim 7, wherein the handle is irremovably fixed to the shaft such that only upon rotating and pushing the handle does the handle engage the shaft in the second state.

13. A switch assembly comprising:

at least one switch; and an actuation system for actuating the at least one switch, wherein the actuation system comprises:

a gearbox mounted on the at least one switch, wherein the gearbox comprises a linear actuator for actuating the at least one switch;

a shaft coupled to the linear actuator and projecting from the gearbox such that rotation of the shaft drives the linear actuator; and a handle irremovably fixed to the shaft such that the handle is selectively engageable with the shaft for rotating the shaft to drive the linear actuator;

wherein the at least one switch comprises a plurality of switches each comprising a lever, the actuation system coupled to the plurality of switches for collectively displacing the lever of each of the plurality of switches;

wherein the actuation system further comprises an elongate sleeve that receives the lever of each of the plurality of switches, the linear actuator collectively displacing the lever of each of the plurality of switches by displacing the elongate sleeve;

wherein the linear actuator comprises a rack-and-pinion gear assembly; and wherein the actuation system further comprises a yoke that straddles the elongate sleeve for displacing the elongate sleeve.

14. The switch assembly of claim 13, wherein the rack-and-pinion gear assembly comprises a rack integrally formed with the yoke.

15. The switch assembly of claim 13, wherein the handle turns relative to the shaft in a first state and rotates the shaft when turned in a second state.

16. The switch assembly of claim 13, wherein the handle is coupled to the shaft for keyed interaction with the shaft.

17. The switch assembly of claim 16, wherein the handle comprises a spring and a housing displaceable along the shaft against a bias of the spring to enable the keyed interaction of the handle with the shaft.

18. The switch assembly of claim 17, further comprising a lug coupled to the shaft, wherein the lug defines a key and the housing defines a keyhole such that the key of the lug is insertable into the keyhole of the housing to enable the keyed interaction of the handle with the shaft.

19. The switch assembly of claim 13, further comprising an enclosure having a door, and the handle being housed within the enclosure.

20. The switch assembly of claim 19, wherein the handle is an internal handle, and wherein the switch assembly further comprises an external handle mounted on the door of the enclosure, the external handle engaging the shaft when the door is closed.

21. The switch assembly of claim 20, wherein the external handle removably receives the shaft when the door is closed.

22. The switch assembly of claim 13, wherein the gearbox comprises a cover sized to surround the linear actuator and the sleeve.

* * * * *